US007030568B2

(12) United States Patent
Böke et al.

(10) Patent No.: US 7,030,568 B2
(45) Date of Patent: Apr. 18, 2006

(54) CIRCUIT ARRANGEMENT FOR OPERATION OF ONE OR MORE LAMPS

(75) Inventors: Ulrich Böke, Langerwehe (DE); Antoon J. Bock, Landgraaf (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/500,508

(22) PCT Filed: Dec. 18, 2002

(86) PCT No.: PCT/IB02/05467

§ 371 (c)(1),
(2), (4) Date: Jun. 29, 2004

(87) PCT Pub. No.: WO03/056885

PCT Pub. Date: Jul. 10, 2003

(65) Prior Publication Data

US 2005/0077842 A1 Apr. 14, 2005

(30) Foreign Application Priority Data

Jan. 2, 2002 (DE) ..... 102 00 022

(51) Int. Cl.
*H05B 37/02* (2006.01)
*H05B 37/00* (2006.01)

(52) U.S. Cl. ..... 315/224; 315/312

(58) Field of Classification Search ..... 315/224, 315/209, 225–226, 312, 219, 245, 243, 244; 363/34, 42; 330/225
See application file for complete search history.

(56) References Cited

U.S. PATENT DOCUMENTS

| | | | | |
|---|---|---|---|---|
| 5,349,269 A | | 9/1994 | Kimball | 315/169.3 |
| 5,434,479 A | * | 7/1995 | Ohnishi et al. | 315/209 R |
| 5,615,093 A | | 3/1997 | Nalbant | 363/25 |
| 5,677,602 A | * | 10/1997 | Paul et al. | 315/224 |
| 5,744,915 A | | 4/1998 | Nilssen | 315/209 |
| 5,777,860 A | * | 7/1998 | Halbert | 363/34 |
| 5,892,674 A | * | 4/1999 | Shimada et al. | 363/127 |
| 6,023,193 A | * | 2/2000 | Ierymenko | 330/255 |
| 6,181,076 B1 | * | 1/2001 | Trestman et al. | 315/224 |
| 6,181,079 B1 | | 1/2001 | Chang et al. | |
| 6,448,720 B1 | * | 9/2002 | Sun | 315/219 |
| 6,535,403 B1 | * | 3/2003 | Jungreis et al. | 363/42 |
| 6,680,584 B1 | * | 1/2004 | Ohsawa | 315/224 |
| 6,717,371 B1 | * | 4/2004 | Klier et al. | 315/274 |

FOREIGN PATENT DOCUMENTS

| | | |
|---|---|---|
| DE | 4436463 | * 10/1994 |
| DE | 4436463 | 4/1996 |
| EP | 1263021 A1 | 12/2002 |

OTHER PUBLICATIONS

"A 1.2 kW Electronic Ballast for Multiple Lamps, with Dimming Capability and High-Power-Factor", by Gules et al, Applied Power Electronics Conference and Exposition, 1999, pp. 720-726.

"A Comparison of Power Circuit Topologies and Control Techniques for a High Frequency Ballast", by Tadesse et al, Industry Applications Society Annual Meeting, 1993, pp. 2341-2347.

"High-Quality Rectifiers with High-Frequency Insulation—An Overview", by Spinazzi et al, Industrial Electronics, 1995, pp. 64-71.

* cited by examiner

*Primary Examiner*—Trin Vo Dinh
*Assistant Examiner*—Hung Tran Vy

(57) ABSTRACT

The invention relates to a background lighting system for a liquid crystal display, more particularly to an electronic circuit for operation of one or more discharge lamps. A DC/AC full-bridge inverter circuit generates two voltages whose AC components are phase-shifted by 180°. The discharge lamps are supplied with the sum of these two AC voltages.

6 Claims, 6 Drawing Sheets

CIRCUIT ARRANGEMENT FOR OPERATION OF ONE OR MORE LAMPS

Figure 1:
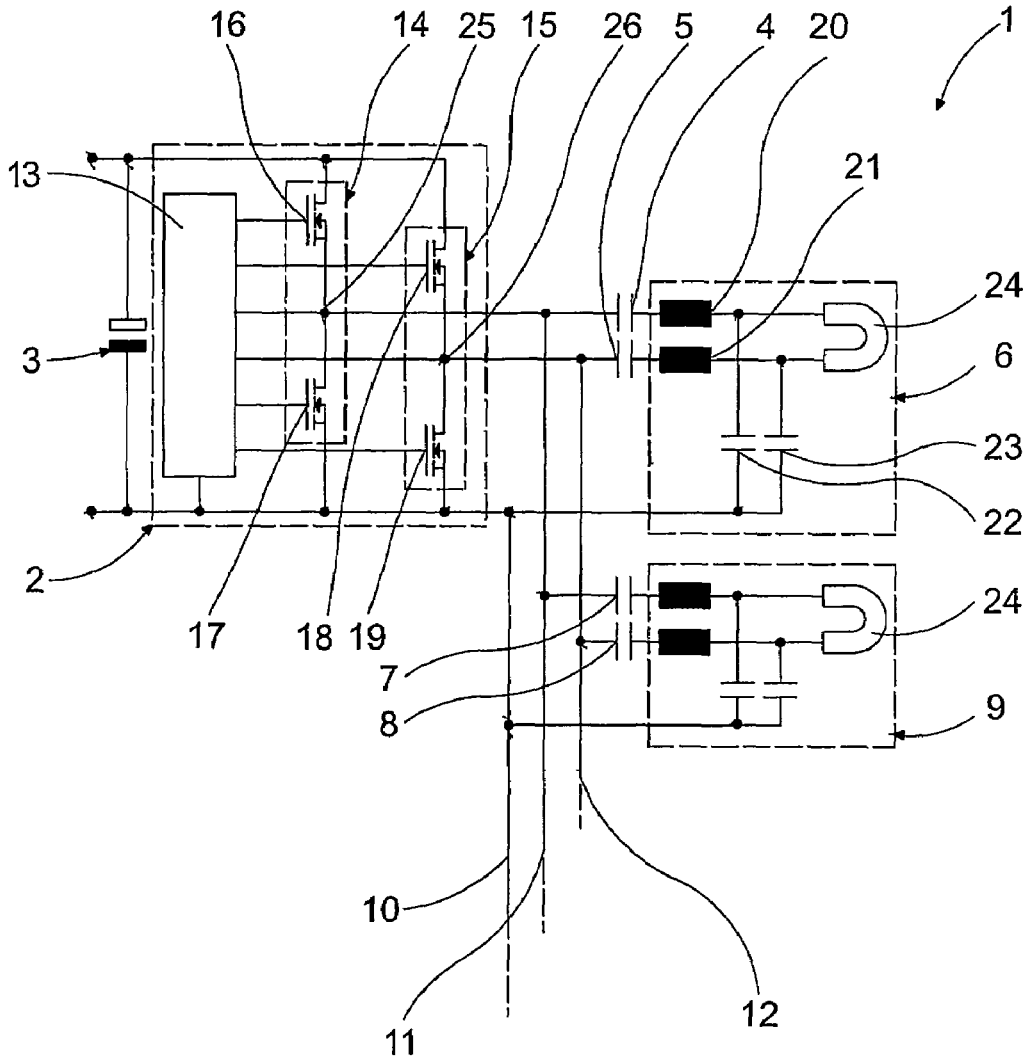

The invention relates to a circuit arrangement for operating one or more low-pressure gas discharge lamps, comprising a current converter and a driving device for the current converter.

Such a circuit arrangement for operating one or more low-pressure gas discharge lamps is known from DE 44 36 463 A1. This particularly relates to a circuit arrangement which is suitable for operation of compact low-pressure gas discharge lamps whose operating voltage exceeds the AC voltage generated by the converter and is suitable for the operation of miniature phosphor lamps. In these circuit arrangements the principle of resonance step-up is used not only for generating the ignition voltage necessary for the low-pressure gas discharge lamp, but also for supplying the operating voltage of the lamp. This implies a reactive power flux at the operating voltage.

High voltages can also be generated by using a transformer such as described in U.S. Pat. No. 6,181,079 B1. Such transformers are awkward and heavy.

It is therefore an object of the invention to indicate a simple circuit arrangement for igniting and operating such lamps. More particularly a circuit arrangement is indicated that feeds a plurality of low-pressure gas discharge lamps in the background lighting of a liquid crystal display from a voltage source.

This object is achieved in accordance with the characteristic features of claim 1. According to the invention a second current converter generates a voltage shifted by 180°.

Liquid crystal displays, also called LCDs for short, are nowadays also used as liquid crystal picture screens. The liquid crystal picture screens are passive display systems i.e. they do not light up by themselves. These picture screens are based on the principle that light either passes the layer of liquid crystals or not. This means that an external light source is necessary for producing a picture. For this purpose an artificial light is generated in the background lighting system. With an increasing size of the liquid crystal picture screens, also the performance level for the background lighting system of such picture screens increases. Lamps of small diameter are desired for these background lighting systems. Compared to other low-pressure gas discharge lamps in lighting arrangements, low-pressure gas discharge lamps in background lighting systems of liquid crystal picture screens have a smaller inner diameter from 2 mm to 3.5 mm and, therefore, four to eight times higher lamp voltages. Thinner lamps for LCDs such as Ceralight lamps as known from EP 1 263 021 A1 work with 300 to 400 volts operating voltage, and cold cathode lamps in the following called Cold Cathode Fluorescent Lamps or CCFLs for short, work with 600 to 800 volts operating voltage. The ignition voltages to start these lamps are moreover higher by a factor of two. These high ignition and operating voltages for thin low-pressure gas discharge lamps are generated without a transformer in that the low-pressure gas discharge lamps are supplied with power by two series-connected AC voltages. Since the two AC voltages have a 180° phase difference, the sum of the two AC voltages is applied to the low-pressure gas discharge lamp. In addition, these AC voltages are generated with moderate reactive power flux in the resonant circuits. For this purpose, the circuit arrangement has low power losses and thus a smaller thermal load in the closed housing of the liquid crystal picture screen.

A circuit arrangement advantageously converts DC voltage into AC voltage and feeds one or several lamps which use a full-bridge switching circuit of power switches as a current converter and two resonant circuits per lamp, each of the resonant circuits comprising one series-connected coil, one series-connected capacitor and one parallel-connected capacitor. This circuit arrangement comprises one full-bridge current converter and one resonant circuit per lamp. This provides that any number of lamps can be operated with a single current converter. This converter is thus scalable. The advantage of the full-bridge converter is that it generates a double output voltage compared to a half-bridge converter, without utilizing a transformer. The two half bridges work with 180° phase distance. The ignition of the lamps and the power flux at normal operation is controlled by the switching frequency. The input impedance of the resonant circuit is then always ohmic inductive to have the power semiconductors of the full-bridge converter operate with minimum switching losses. This configuration has the advantage of a lower voltage load of the parallel capacitors.

The resonant circuits can additionally be constructed in three further circuit arrangements. Advantageously, a second circuit arrangement converts DC current into AC current and feeds one or more lamps which utilize a full-bridge circuit of power switches as a current converter, two series-connected capacitors and two resonant circuits per lamp, each of the resonant circuits comprising a series-connected coil and a parallel-connected capacitor.

A third circuit arrangement advantageously converts DC current into AC current and feeds one or more lamps which utilize a full-bridge switching circuit comprising power switches as a current converter and one resonant circuit per lamp, which resonant circuit comprises one series-connected coil, one series-connected capacitor and one parallel-connected capacitor.

A fourth circuit arrangement advantageously converts DC current into AC current and feeds one or more lamps which utilize a full-bridge switching circuit with power switches as a current converter, two series-connected capacitors and one resonant circuit per lamp, which resonant circuit comprises one series-connected coil and one parallel-connected capacitor.

The parallel-connected capacitor is advantageously formed at least partly by a parasitic capacitance between the lamps and a metallic portion, thus the lamp electrodes and the electrically conductive parts of the display, for example, of the reflector.

Figure 2:
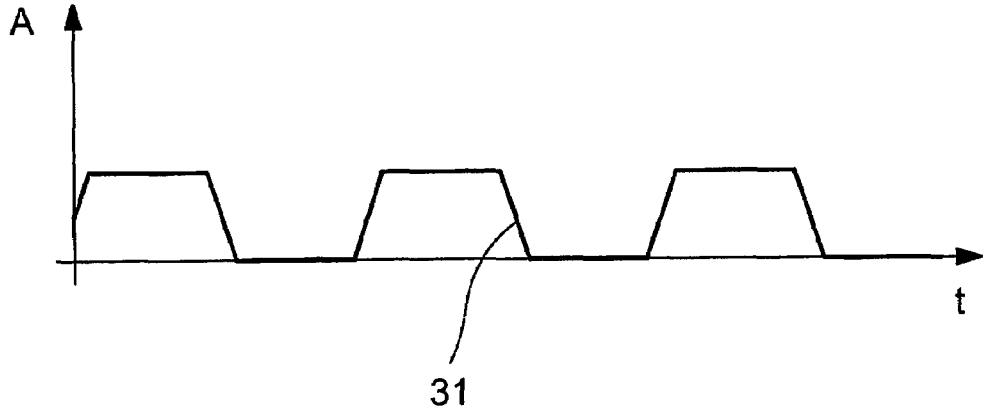
Figure 3:
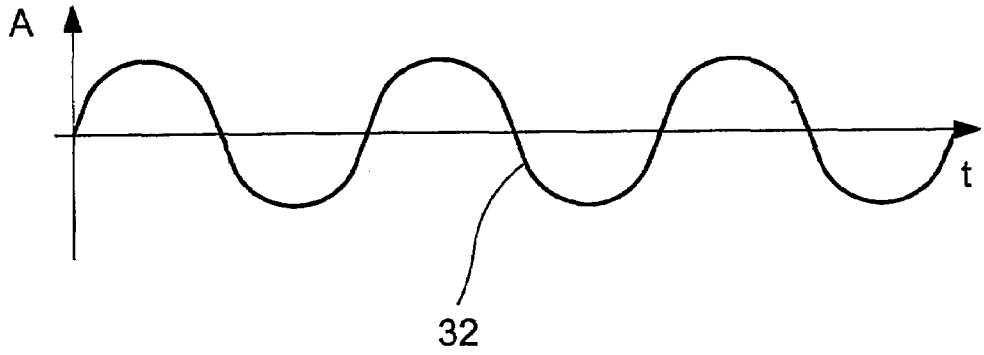
Figure 4:
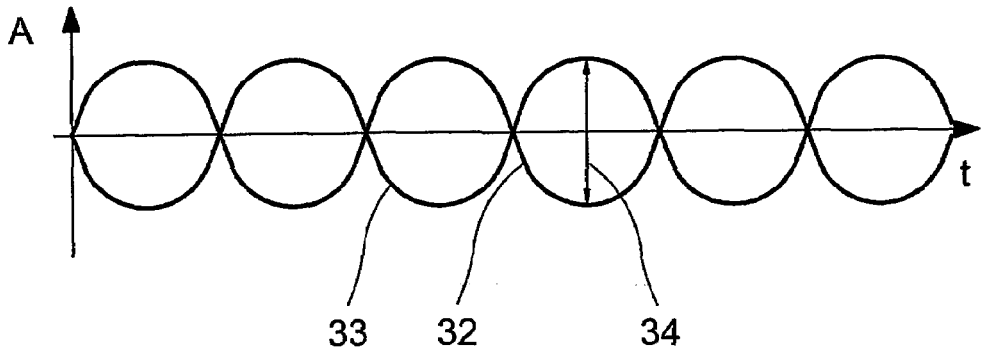
Figure 5:
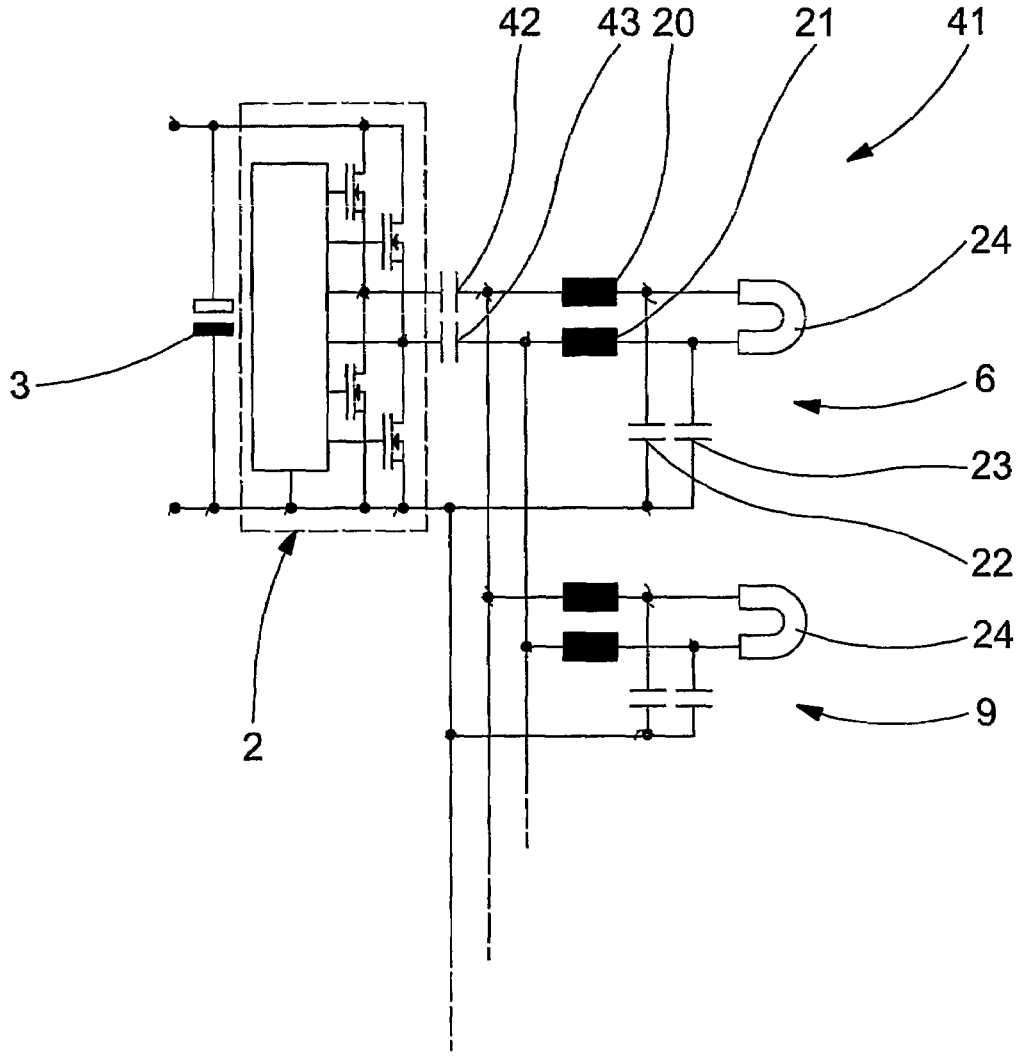
Figure 6:
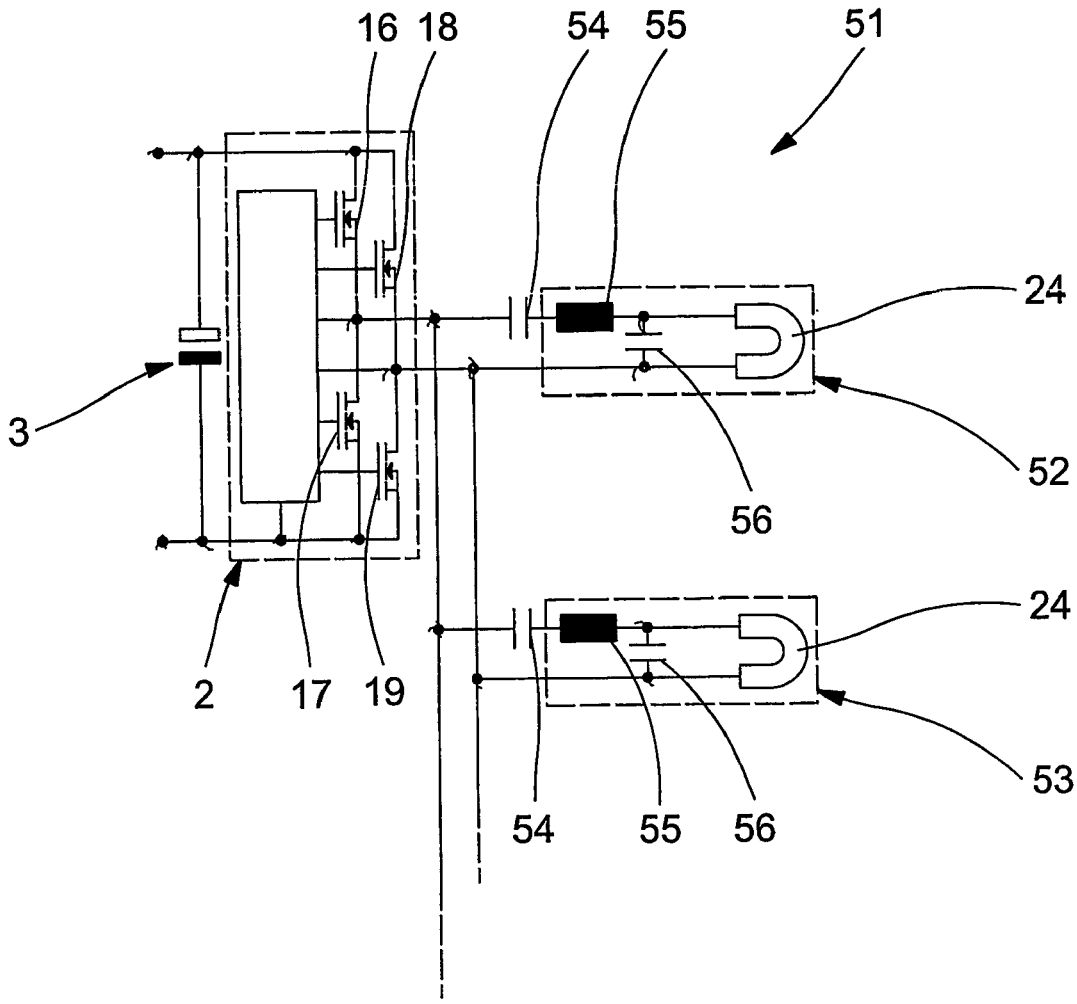
Figure 7:
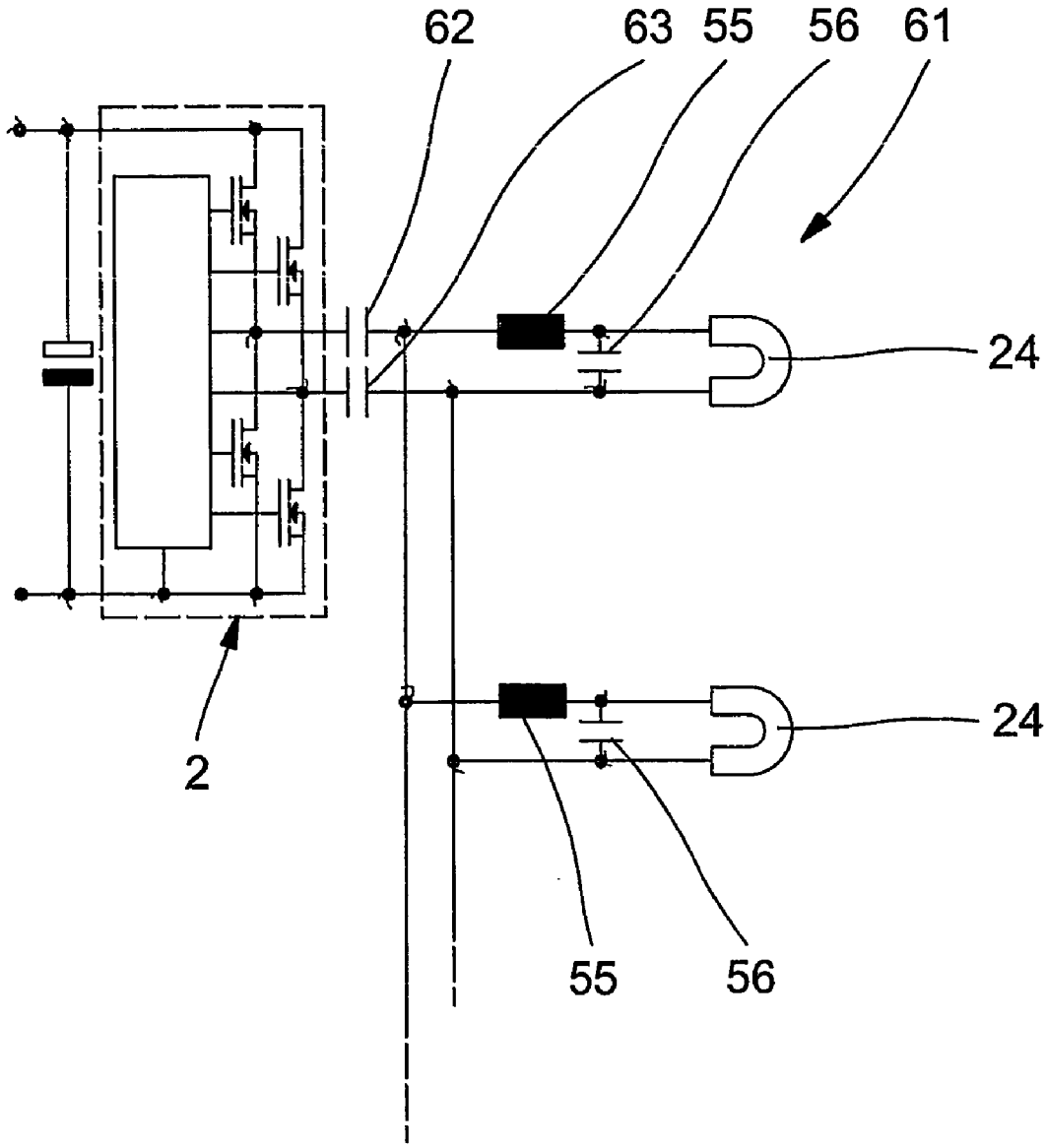
Figure 8:
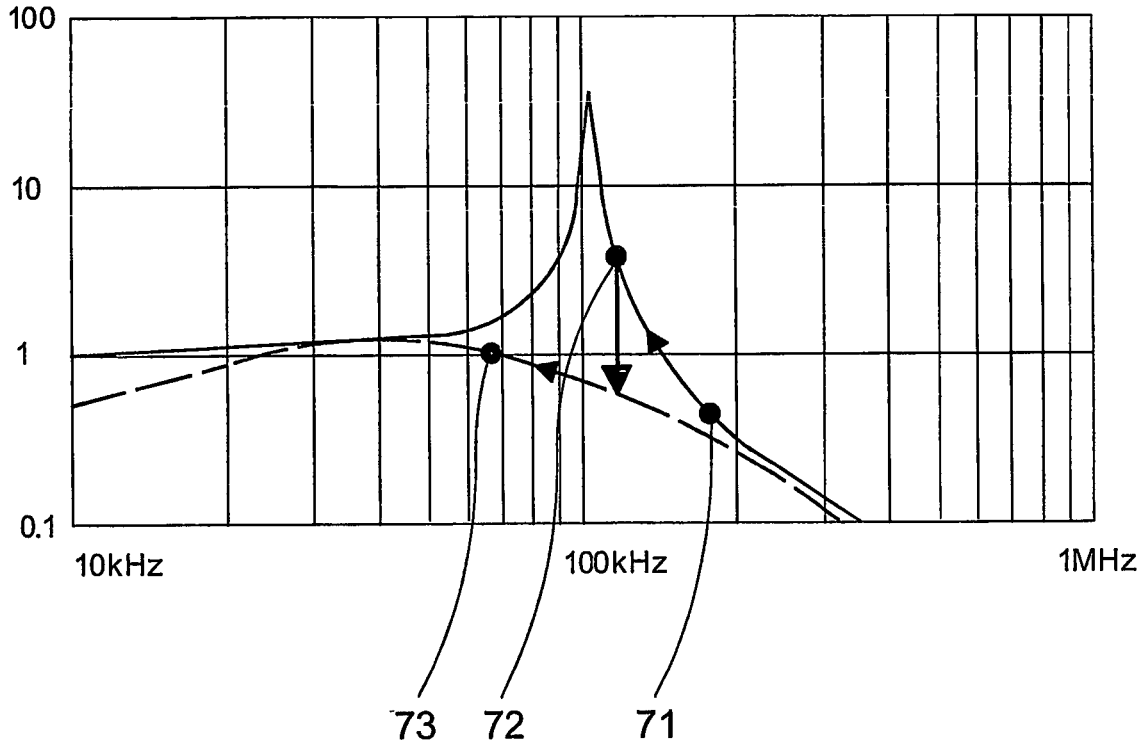

To better understand the invention, an example of embodiment will be further explained hereinbelow with reference to the drawing in which:

FIG. 1 shows a circuit arrangement for converting DC current into AC current and for feeding one or more low-pressure gas discharge lamps, FIG. 2 shows a timing diagram with a rectangular signal waveform, FIG. 3 shows a timing diagram with a sine curve, FIG. 4 shows a timing diagram with two sine curves phase-shifted by 180°, FIG. 5 shows a second circuit arrangement for converting DC current into AC current and for feeding one or more low-pressure gas discharge lamps, FIG. 6 shows a third circuit arrangement for converting DC current into AC current and for feeding one or more low-pressure gas discharge lamps, FIG. 7 shows a fourth circuit arrangement for converting DC current into AC current and for feeding one or more low-pressure gas discharge lamps, and FIG. 8 shows a diagram with a voltage ratio plotted against frequency.

FIG. 1 shows an electronic circuit arrangement 1 comprising a full-bridge switching circuit 2, a voltage source 3, two high pass filters 4 and 5, a first lamp switching circuit 6, two further high pass filters 7 and 8 and a second lamp switching circuit 9. Electrically conducting lines 10, 11 and 12 lead to further lamp switching circuits (not shown). The full-bridge switching circuit 2 also called full-bridge inverter in the following, comprises a control circuit 13 and two current converters 14 and 15. The current converter 14, in the following also called inverter, includes two power switches 16 and 17, and the second inverter 15 also includes two power switches 18 and 19. Power semiconductors such as bipolar transistors, IGBTs (Integrated Gate Bipolar Transistors) are also MOSFETs are used as power switches. The first lamp switching circuit 6 includes two series-connected coils 20 and 21, two parallel-connected capacitors 22 and 23 and one low-pressure gas discharge lamp 24. The second lamp circuit 9 has a similar structure with components 20 to 24. The control circuit 13 controls the first inverter 14 so that the power semiconductors 16 and 17 open and close in a push-pull mode. A rectangular signal waveform evolves at a node 25 between the power semiconductors 16 and 17. The control circuit 13 controls the second inverter 15 SO that the power semiconductors 18 and 19 also open and close in a push-pull mode. A rectangular signal waveform also evolves at a node 26 between the power semiconductors 18 and 19. The two inverters 14 and 15 work in phase opposition, so that two rectangular signal waveforms evolve shifted by 180°. The high pass filters 4, 5, 7 and 8 filter out the high-frequency components, so that two sinusoidal signals shifted in phase by 180° reach the lamps 24. The series-connected coil 20 and the parallel-connected capacitor 22 form a first resonant circuit 20, 22, the coil and the capacitor 23 form a second resonant circuit 21, 23. The high pass filters 4 and 5, the coils 20 and 21 and the lamp 24 are connected in series between the two nodes 25 and 26. The capacitors 22, 23 are connected in parallel to the lamp 24 and to the minus pole of the DC voltage source 3. The half lamp voltage is applied via the capacitors 22 and 23, respectively.

FIG. 2 shows a rectangular signal waveform 31 which arises at the node 25. A similar signal waveform arises at node 26. The two rectangular signal waveforms are phase-shifted by 180°.

FIG. 3 shows a sinusoidal signal waveform 32 which evolves as a result of the smoothing by the high pass filter 4.

FIG. 4 shows a sine curve 32 and a second sine curve 33 shifted by 180°, which is filtered by the high pass filter 5. In this way a maximum voltage amplitude 34 corresponding to the value of the voltage supply 3 arises at the lamp 24.

FIG. 5 shows a second circuit arrangement 41 comprising a full-bridge inverter 2 and the lamp switching circuits 6 and 9. Two high pass filters 42 and 43 filter out the low frequency and DC components for all the lamp circuits 6 and 9.

FIG. 6 shows a third circuit arrangement 51 comprising the full-bridge inverter 2, the voltage source 3 and two lamp switching circuits 52 and 53. Between the two nodes 25 and 26 in the lamp circuit 52 is connected a capacitor 54, a coil 55 and a capacitor 56 which together work as a low-pass filter, and a low-pressure gas discharge lamp 24 in parallel with capacitor 56. The coil 55 and the capacitor 56 form a resonant circuit 55, 56.

The coil 55 has double the inductance of coil 20, the capacitor 56 half the capacitance of the capacitor 22. There is a voltage drop across the capacitor 56, which drop corresponds to the lamp voltage.

FIG. 7 shows an electrical circuit arrangement 61 with two series-connected capacitors 62, 63 which work for all the lamp circuits 52, 53.

FIG. 8 shows a diagram in which the voltage is plotted against frequency. The AC power gain function of a resonant circuit is shown as a function of the switching frequency. To ignite a low-pressure gas discharge lamp, the full-bridge starts with a starting frequency 71, reduces the switching frequency until the lamp ignites at an ignition frequency 72 and reduces the switching frequency further to an operating frequency 73.

List of Reference Characters:

1 circuit arrangement
2 full-bridge inverter
3 voltage source
4 low-pass filter
5 low-pass filter
6 lamp switching circuit
7 low-pass filter
8 low-pass filter
9 lamp switching circuit
10 electrically conducting line
11 electrically conducting line
12 electronically conducting line
13 control circuit
14 inverter
15 inverter
16 power switch
17 power switch
18 power switch
19 power switch
20 series coil
21 series coil
22 capacitor
23 capacitor
24 lamp
25 node
26 node
31 rectangular signal waveform
32 sinusoidal fundamental wave
33 second sinusoidal fundamental wave
34 voltage amplitude
41 second circuit arrangement
42 low-pass filter
43 low-pass filter
51 third circuit arrangement
52 lamp switching circuit
53 lamp switching circuit
54 capacitor
55 coil
56 capacitor
61 four circuit arrangement
62 capacitor
63 capacitor
71 start frequency
72 ignition frequency
73 operating frequency

The invention claimed is:

1. In a circuit for operating one or more low pressure gas discharge lamps, the circuit including a first half-bridge switching circuit having a first output and a second half-bridge switching circuit having a second output, the first half-bridge switching circuit operating substantially 180° out of phase from the second half-bridge switching circuit;

characterized by a lamp drive circuit for each lamp, each lamp drive circuit comprising:

a first resonant circuit having an input coupled to the output of said first half-bridge switching circuit and a first output adapted to connect to a first end of a low pressure gas discharge lamp; and a second resonant circuit having an input coupled to the output of said second half-bridge switching circuit and a second output adapted to connect to a second end of said low pressure gas discharge lamp.

2. A liquid crystal display on which a video signal of a computer or of a television set can be represented, comprising a circuit as claimed in claim 1.

3. The circuit as set forth in claim 1 wherein said first resonant circuit includes a first capacitor connected in series with a first inductor and the junction thereof is said coupled to said first output; and said second resonant circuit includes a second capacitor connected in series with a second inductor and the junction thereof is said coupled to said second output.

4. The circuit as set forth in claim 3 wherein at least one of said first capacitor and said second capacitor includes a parasitic capacitance.

5. In a circuit for operating one or more low pressure gas discharge lamps, the circuit including a full-bridge switching circuit in which alternate arms conduct simultaneously to produce a first square wave at a first output and a second square wave at a second output substantially 180° out of phase with the first square wave, characterized by a lamp drive circuit for each lamp, each lamp drive circuit comprising:

a first resonant circuit having an input coupled to the first output and a first output adapted to connect to a first end of a low pressure gas discharge lamp; and a second resonant circuit having an input coupled to the second output and a second output adapted to connect to a second end of the low pressure gas discharge lamp.

6. The circuit as set forth in claim 5 wherein the first resonant circuit and the second resonant circuit are capacitively coupled to said full-bridge switching circuit.

* * * * *